US007736171B2

(12) United States Patent
Reed et al.

(10) Patent No.: US 7,736,171 B2
(45) **Date of Patent: *Jun. 15, 2010**

(54) LOW PROFILE LATCHING CONNECTOR

(75) Inventors: Bruce Reed, Maumelle, AR (US); Jay H. Neer, Boca Raton, FL (US); Cleaver Brinkerhoff, Wilmington, IL (US); Dennis Lee Doye, Maumelle, AR (US)

(73) Assignee: Molex Incorporated, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/906,287

(22) Filed: Oct. 1, 2007

(65) Prior Publication Data

US 2008/0032541 A1 Feb. 7, 2008

Related U.S. Application Data

(63) Continuation of application No. 11/241,545, filed on Sep. 30, 2005, now Pat. No. 7,281,937.

(60) Provisional application No. 60/654,762, filed on Feb. 18, 2005.

(51) Int. Cl.
*H01R 13/627* (2006.01)

(52) U.S. Cl. ..... 439/352

(58) Field of Classification Search ..... 439/350–355, 439/357, 358, 483, 258
See application file for complete search history.

(56) References Cited

U.S. PATENT DOCUMENTS 4,810,210 A 3/1989 Komatsu
4,838,808 A 6/1989 Fujiura
5,564,939 A * 10/1996 Maitani et al. ..... 439/352
5,634,809 A 6/1997 Hirai
5,915,987 A 6/1999 Reed et al.
5,951,316 A 9/1999 Kawano et al.
6,431,887 B1 8/2002 Yeomans
6,447,170 B1 * 9/2002 Takahashi et al. ..... 385/53
6,702,603 B2 3/2004 Wu
6,746,264 B1 6/2004 Branch et al.
6,786,653 B1 9/2004 Hwang et al.
7,008,253 B2 3/2006 Szczesny
7,114,980 B1 10/2006 Wu
7,134,914 B1 11/2006 Wu
7,160,135 B1 1/2007 Wu
2005/0233631 A1 * 10/2005 Wu ..... 439/352

OTHER PUBLICATIONS

International Search Report for PCT/US2005/0044756.

* cited by examiner

*Primary Examiner*—Tho D Ta
(74) *Attorney, Agent, or Firm*—Stephen L. Sheldon

(57) ABSTRACT

A small, low-profile plug connector for use with electronic devices provides a latching member with a pair of hooks that engage mating holes in a guide frame, and which can be easily delatched from the guide frame or opposing connector or housing. The hooks lock the plug connector into engagement with the frame or housing, but are readily released by way of a simple ramp and lobe mechanism in the plug connector. The ramp and lobe mechanism converts horizontal movement of a pull tab-like actuator into vertical movement of a latching member such that the hooks are lifted upward and disengaged from the guide frame or housing.

3 Claims, 11 Drawing Sheets

FIG.5
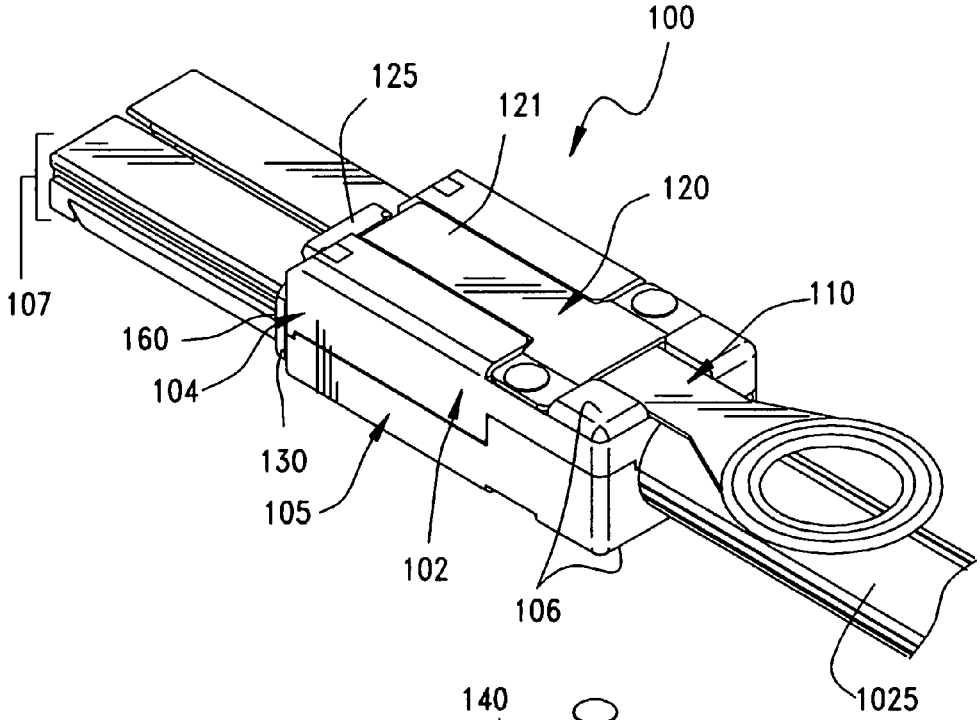
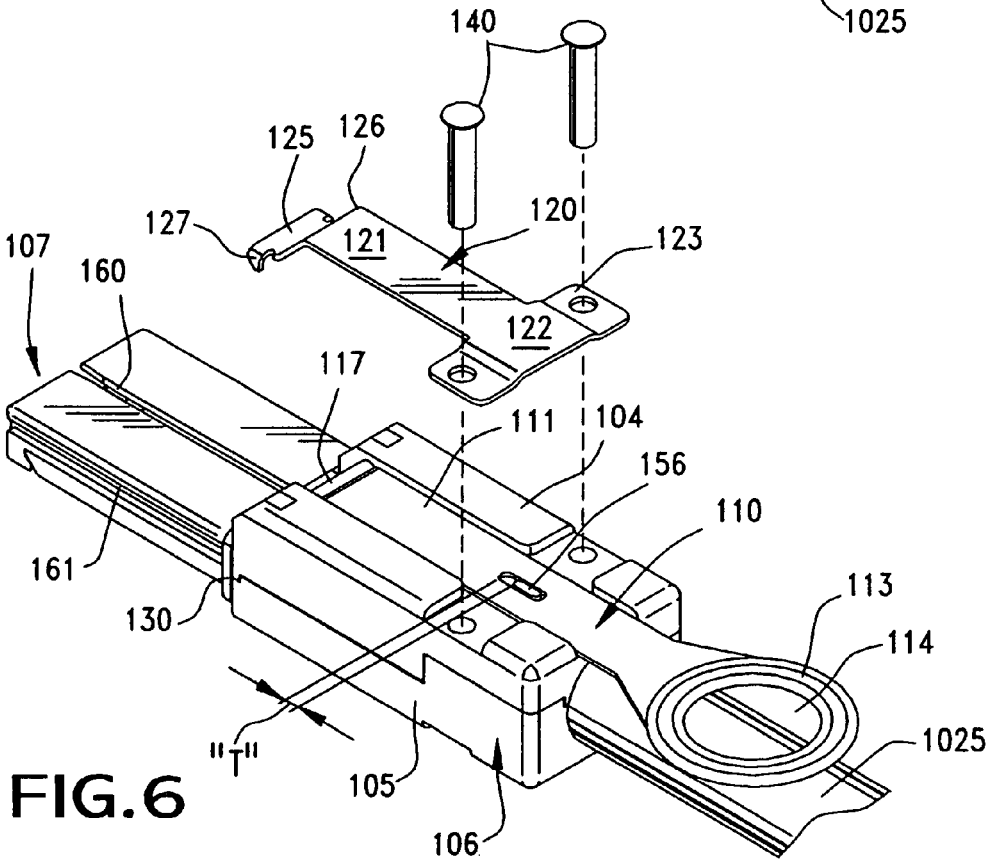
FIG.6

FIG.7
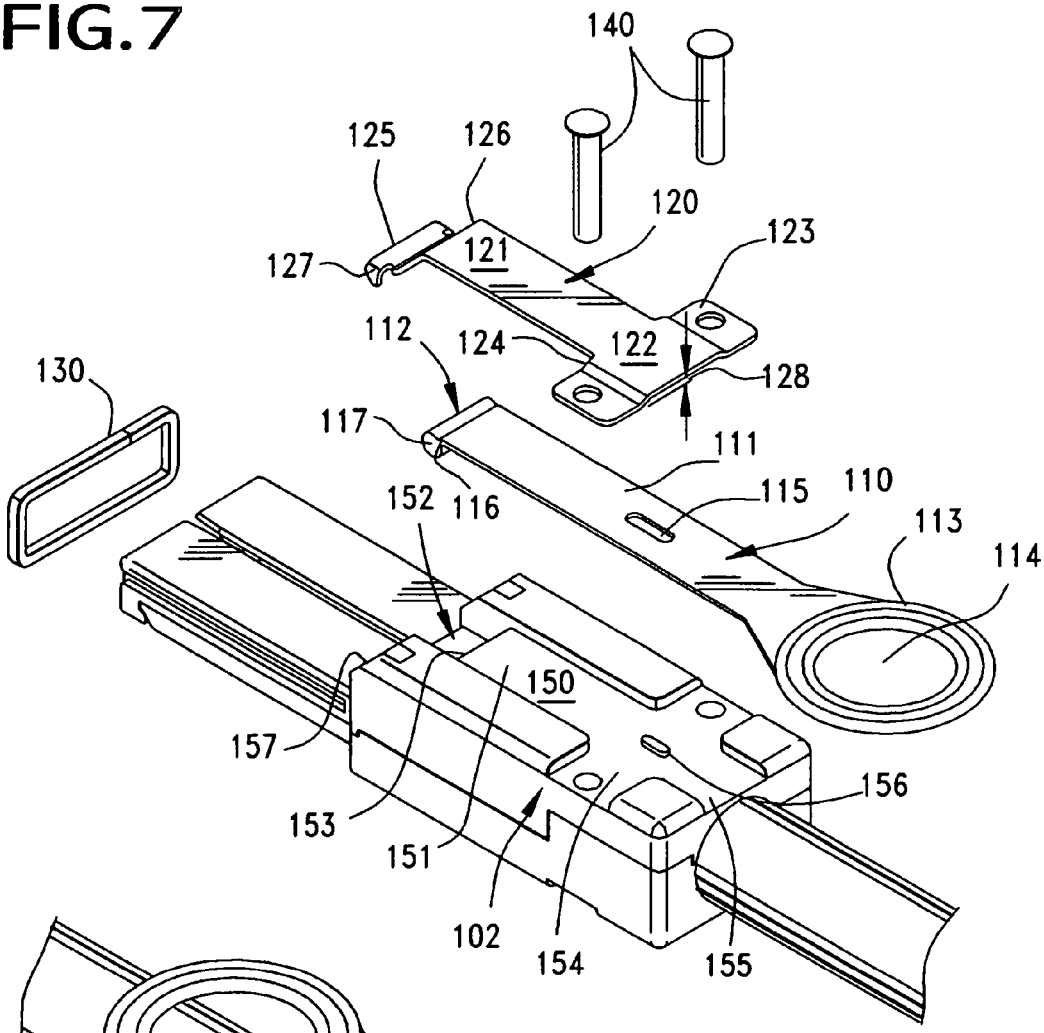
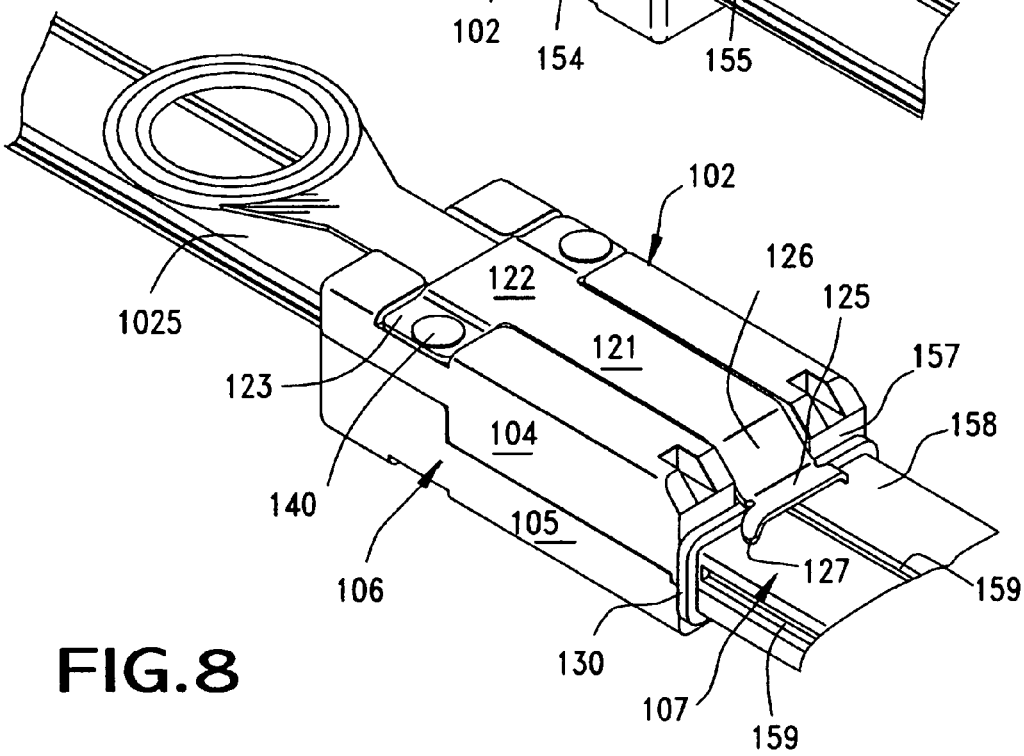
FIG.8

FIG.9
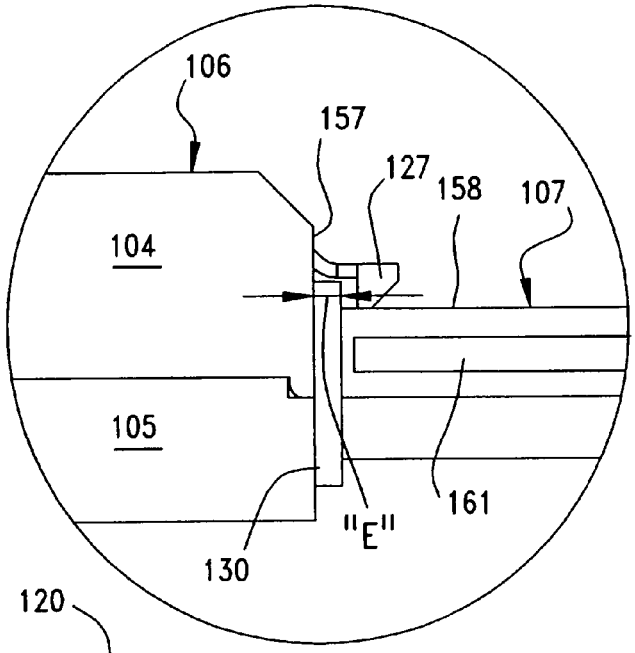
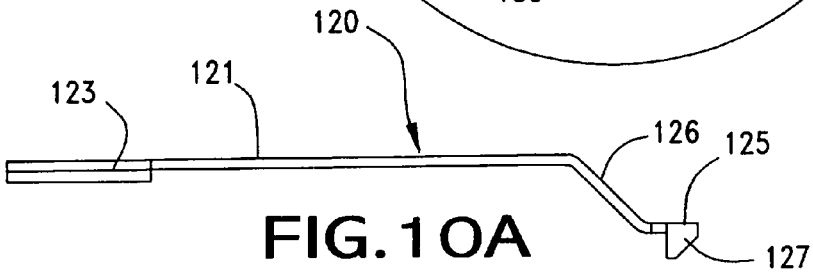
FIG.10A
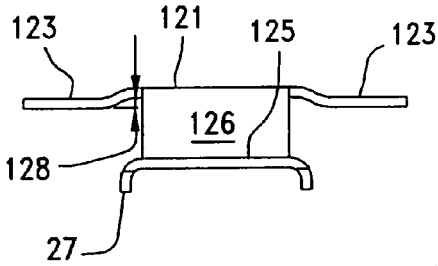
FIG.10B
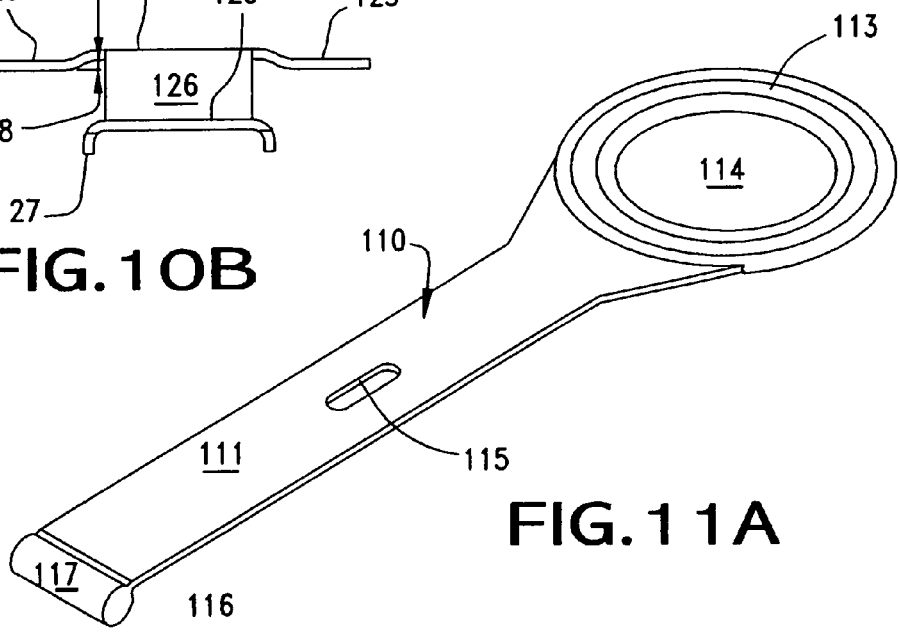
FIG.11A

FIG. 11B
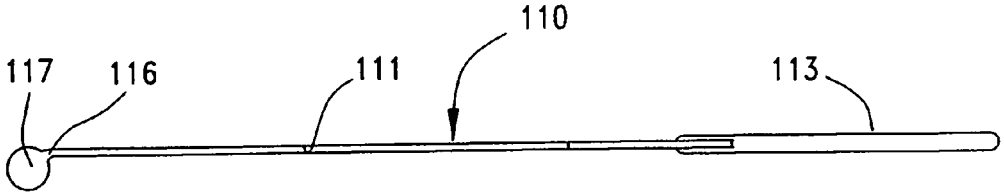
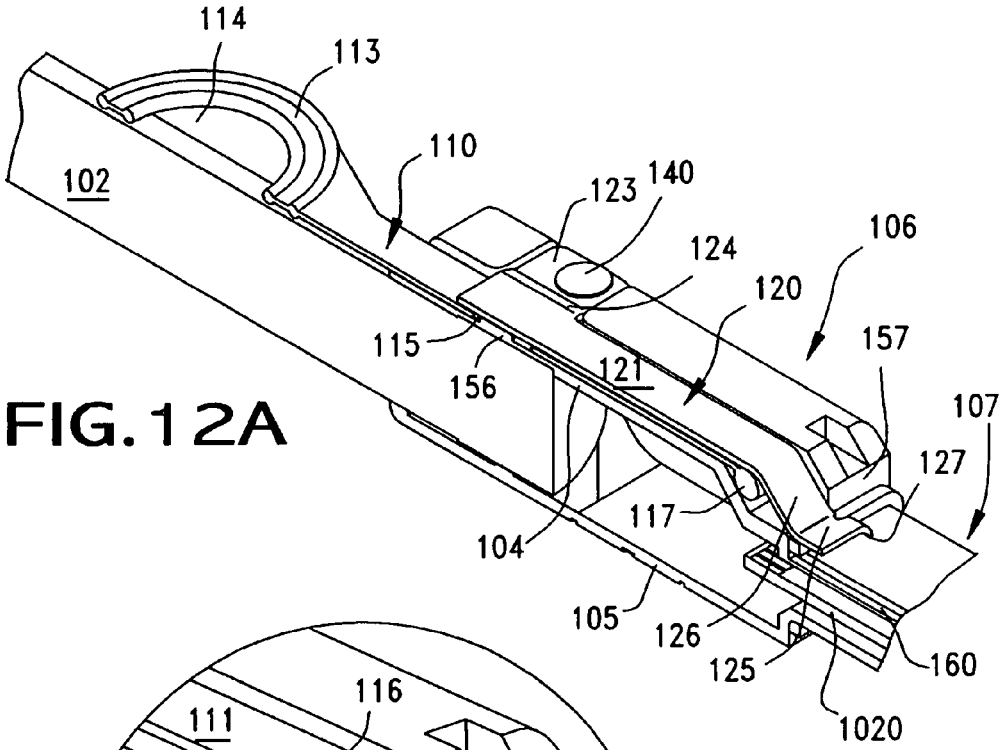
FIG. 12A
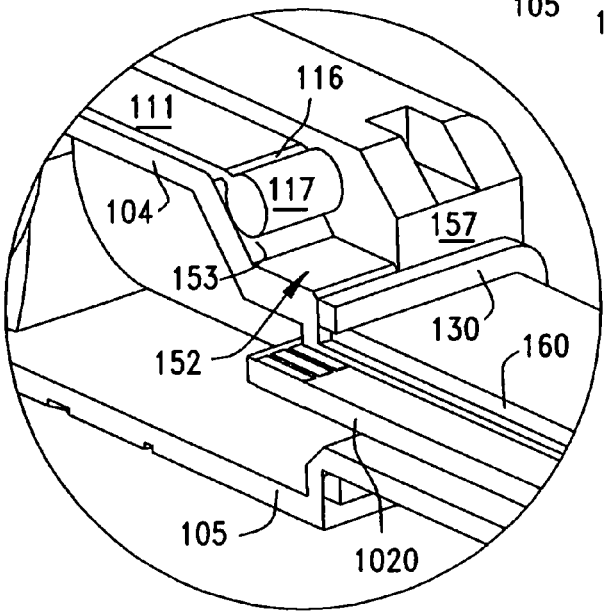
FIG. 12C

LOW PROFILE LATCHING CONNECTOR

REFERENCE TO RELATED APPLICATIONS

This application is a continuation of U.S. application Ser. No. 11/241,545, filed Sep. 30, 2005, now U.S. Pat. No. 7,281,937, which claims priority from prior U.S. Provisional Patent Application No. 60/654,762, filed Feb. 18, 2005.

BACKGROUND OF THE INVENTION

The present invention is directed to small and low-profile connectors. More particularly, the present invention is directed to pluggable-style connectors that are received within a housing, or guide frame, and which require some sort of exterior latch to retain the connector in its mated engagement with the housing or guide frame.

Small and low-profile connectors, such as those used in SFP (Small Form Factor Pluggable) applications are desired in electronic devices in which space is a premium. Such connectors are widely used to make connections with routers and servers. They are small in size. A problem with many electronic connectors of this type, however, is the tendency for them to separate or be disconnected from the component to which they are connected.

Connectors, and particularly plug connectors, can be made more reliable and separation less likely by latching them together. U.S. Pat. No. 5,915,987 issued Jun. 29, 1999 to Reed et al. entitled, "Latched Electrical Connector" discloses a plug-receptacle connector assembly with a latching mechanism incorporated into the housing of the plug connector. One problem with the locking plug connectors such as those disclosed in the '987 patent is that they are not usable with low-profile, high-density receptacle connectors. Their size and the side locations of the actuators for the latching mechanisms of such plug connectors would increase the size required in a system. Such a connector also requires a specially configured housing to receive the plug connector. As connectors become smaller and as the density of receptacle connectors in electronic devices increases, the simple act of disengaging a plug connector latch mechanism becomes increasingly more difficult.

U.S. Pat. No. 6,648,665, issued Nov. 18, 2003 discloses another plug connector in which a latching mechanism is incorporated into the plug connector housing. This connector has a complex mechanical structure with a plurality of parts, such that manufacturing and assembly costs will be increased. It uses two latching elements that extend longitudinally and sideways along the inner walls of the plug connector housing. It is constructed of many separate pieces and is relatively difficult to manufacture, and it requires excessive space at its rear end for an actuator to project.

The present invention is directed to a small size, and low profile pluggable connector that overcomes the aforementioned shortcomings.

SUMMARY OF THE INVENTION

Accordingly, it is a general object of the present invention is to provide a low profile connector with a latching mechanism that secures it to an opposing receptacle.

Another object of the present invention is to provide a low profile plug connector that is usable in high-density electronic devices, but which has a latching mechanism that is not positioned alongside of the plug connector housing.

Another object of the present invention is to provide a plug connector usable in high-density electronic devices, and which has a latching mechanism that is simple to assemble and simple to operate, using a minimum number of components and is reliable.

A further object of the present invention is to provide a connector for mating with a guide frame or other housing that houses a receptacle connector, the connector including a housing, the housing including a plurality of conductive contacts that are terminated to conductors in a cable, the housing having a forward mating end that is received within a portion of the guide frame and further having a body portion that remains exterior of the guide frame, the connector including a latching mechanism disposed on an exterior surface of the connector housing and including means responsive to a pulling action that disengages the latching mechanism from engagement with the guide frame or housing.

Still another object of the present invention is to provide a plug connector for mating with a receptacle connector encompassed by a guide frame, the plug connector and guide frame each having respective aligned first surfaces, the plug connector including a housing with a recess disposed thereon proximate to the first surface thereof, the recess containing a roll pin or wedge member and the recess being covered by a portion of an elongated latching member that extends lengthwise of the plug connector, the latching member having a free end with hook members that are engageable with corresponding openings formed on the guide frame first surface, the roll pin or wedge member having an elongated pull tab attached thereto, whereby pulling on the pull tab moves the roll pin or wedge member into con tact with the latching member and deflecting its hook members out of the guide frame slots.

In a preferred embodiment of the invention, a low-profile latching plug connector is provided that is comprised of a two-section plug connector housing, each section of which preferably includes a rectangular cross-section. A front, or first, section of the plug connector housing is sized, shaped and arranged to fit within a mating receptacle connector and this section includes a mating end with exposed terminals for connecting to opposing terminals in the receptacle connector.

A second, or rear, section of the plug connector may have a larger cross-section than the first section such that it will not fit within the opposing housing or guide frame, and thus may be considered as a body portion of the plug connector. The rear section of the plug connector is also preferably rectangular in cross-section and includes its own terminal end.

The plug connector is latched into a receptacle connector by a latching arm that extends longitudinally of the plug connector, and the rear end of the latching arm is attached to the top of the rear shell and the second end of which is free to provide a cantilevered arrangement. Barbs, or hooks, are disposed at the second, or free end, and are biased in one direction by the structure of the latching arm, downwardly in the preferred embodiment, at the plug connector mating end, where they engage with holes or depressions formed in the exterior surface of the opposing guide frame or housing.

A sliding actuator is provided so that a user may lift the latching member with a simple pull action. The actuator is interposed between the latching arm and an exterior surface of the plug connector housing and it preferably lies below the latching arm but above the top surface of the plug connector housing. The actuator preferably includes a lobe, or enlarged portion, at one end that rides on an inclined surface which is formed as part of the plug connector housing. As the actuator is moved in one direction, preferably away from the mating end of the plug connector, the lobe is likewise moved in the same direction on the inclined surface and in so doing, it contacts the underside of the latching arm and raises it. This raising, lifts the free end of the latching arm and its associated engagement hooks in order to move the engagement hooks out of engagement with the opposing housing.

The actuator preferably includes a pull tab in the form of a finger hole at its rear end into which a user can place a finger to pull the actuator rearwardly. The actuator and plug connector housing include cooperating structure that limits the travel of the actuator. In the preferred embodiment, the housing has a stop member formed on an exterior surface and the actuator has a slot formed in its body that engages the stop member. The length of the slot determines the extent to which the actuator may be moved on the housing.

In the preferred embodiment of the invention, the actuator includes a flat grasping end with an opening that may be either grasped by a user or pulled by insertion of a finger into an opening formed int eh tail end of the actuator. In another embodiment of the invention, the actuator has its tail configured into a loop, that encircles the cables entering the plug connector. The loop may be easily grasped to unlatch the plug connector from an opposing guide frame or housing. The loop and actuator are preferably formed from a plastic or other resilient material and a metal sleeve may be inserted into the loop to provide stiffness in the area encircling the cable leading to the plug connector.

These and other objects, features and advantages of the present invention will be clearly understood through a consideration of the following detailed description.

BRIEF DESCRIPTION OF THE DRAWINGS

In the course of this detailed description below, references will be made to the drawings, in which:

FIG. 5 is a perspective view of another embodiment of a plug connector constructed in accordance with the principles of the present invention, taken from the rear end thereof;

FIG. 6 is an exploded view of FIG. 5, but with the actuator and EMI gasket in place upon the connector;

FIG. 7 is the same view as FIG. 6, but with the actuator and EMI gasket shown exploded from their positions on the connector housing;

FIG. 8 is a perspective view, taken from the front end thereof, of the connector of FIG. 5, illustrating the location of the EMI gasket relative to the connector latching arm;

FIG. 9 is an enlarged side detail view of the connector mating face, illustrating the latching arm and the EMI gasket;

FIG. 10A is a side elevational view of the latching arm of the connector of FIG. 5;

FIG. 10B is a front elevational view of the latching arm of FIG. 10A;

FIG. 11A is a perspective view of the actuator, removed form the connector;

FIG. 11B is a side elevational view of the actuator of the connector of FIG. 5; and, FIG. 12A is a sectional view of the connector 8 taken along a central longitudinal axis thereof.

FIG. 12C is an enlarged detail view of the actuator lobe and the connector housing ramped surface;

DETAILED DESCRIPTION OF THE PREFERRED EMBODIMENTS

Figure 1:
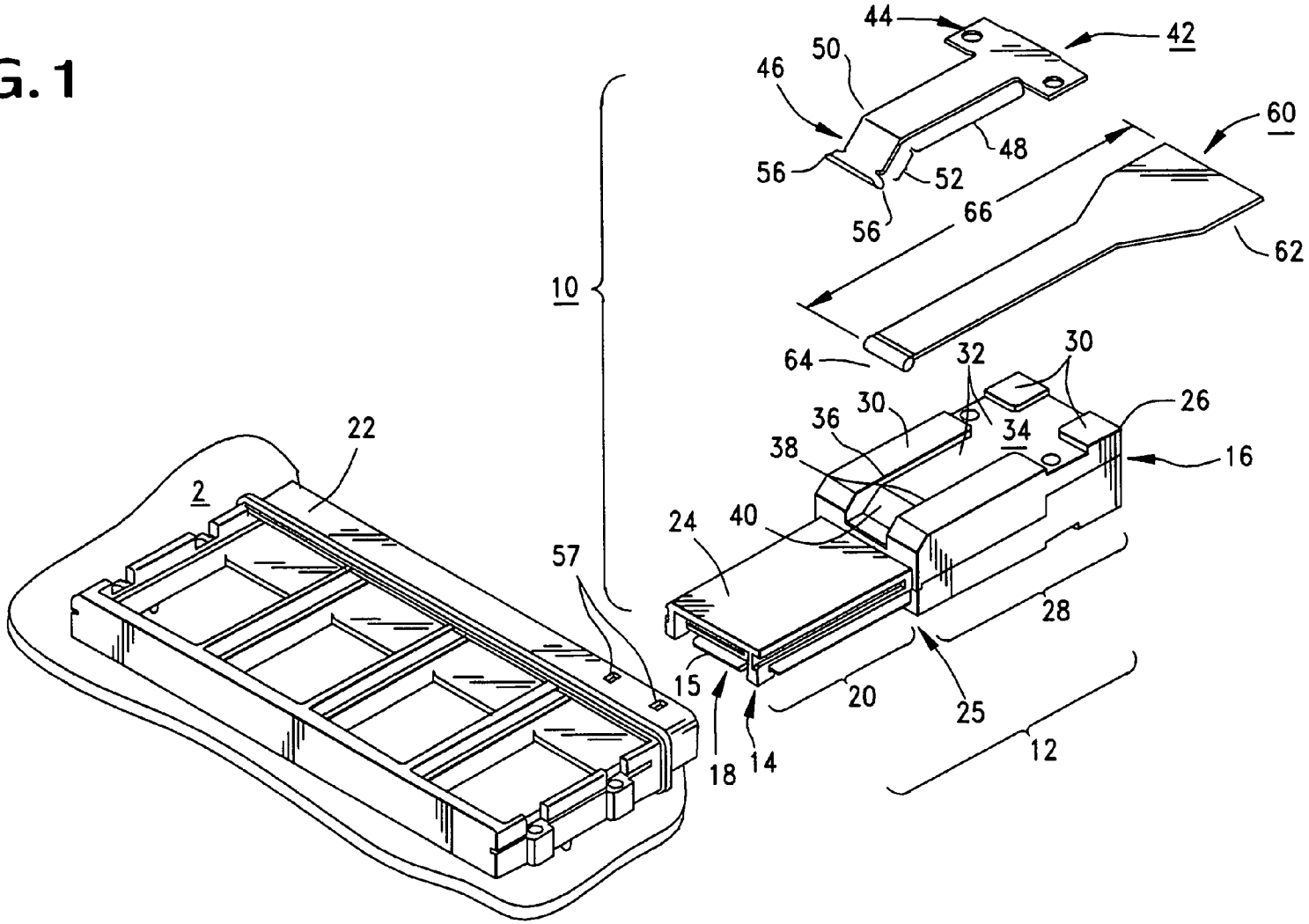
FIG. 1 is an exploded perspective view of a plug connector constructed in accordance with the principles of the present invention.

FIG. 1 is an exploded perspective view of a low-profile plug connector 10 constructed in accordance with the principles of the present invention. The plug connector 10 is seen to include an elongated connector housing 12 having two opposing ends identified in the Figures by reference numerals 14 and 16. The first, or front end, 14 of the plug connector body 12 defines a mating end 18 of the front portion 20 of the plug connector housing 12. This front portion 20 of the connector housing 12 is shown as having has the shape of a rectangular parallelpiped or cuboid, the cross section of which is rectangular. One or more electrical terminals are contained within the front shell 20 in order to make electrical contact with mating terminals in a mating receptacle connector (not shown) which is enclosed within an outer protective guide frame 22, both the receptacle connector and guide frame being mounted to a printed circuit board 2.

The dimensions of the connector housing front portion 20 are such that the front end n fits within an opening of the guide frame 22 that encompasses the receptacle connector. Electrical contacts in the form of traces on a circuit board (not shown) in the preferred embodiment are disposed at the mating end 18 of the front portion 20 for connection to contacts or terminals within the receptacle connector. Typically, the contacts will be arranged along the surface of an edge card or other similar blade for mating to a like plurality of terminals or contacts in the receptacle connector 24. Inasmuch as the front portion 20 is shown as having a rectangular shape, it has a planar top surface 24, which is insertable into the interior portion of the guide frame 22.

The connector housing 12 has a second (or terminating) end 16 that is generally opposite to its first end 14. This second end 16 of the connector housing 12 defines part of a larger body portion 28 of the connector housing 12 that has rear end 26 which may be referred to herein as a terminating end. This body portion 28 has a shape that resembles a parallelpiped and it too has a rectangular cross section, but the rectangular cross section of the body portion 28 is larger in size than the cross-section of the front portion 20. The difference in size between the large body portion 28 and the front portion 20 prevents the body portion 28 from being introduced during mating, into the guide frame 22.

The large body portion 28 has its own top surface 30 that is disposed in a plane that is preferably separate from and spaced apart from the plane in which the mating end surface 24 extends. The large body portion 28 is larger than the front portion 20, and thus the top surface 30 of the large body portion 28 may be considered as located "above" the top surface 24 of the front portion 20. As described more fully below, the elevation or height difference between the second top surface 30 of the large body portion 28 and the first top surface 24 of the front portion 20 enables the formation of an inclined surface, or ramp 40, between them. This defines a cam surface as explained in detail below. The inclined ramp surface 40 serves to converts lateral translation (or movement) of a portion of the actuator 60 into vertical movement of the latching arm 42 to disengage the plug connector 10 from a corresponding opposing guide frame 22.

As can be best seen in FIG. 1, the second top surface 30 of the connector housing large body portion 28 is formed with a rectangular cross-sectioned slot or channel 32, that is open at its top, and which has a bottom 34 and two opposing sides 36 and 38. The channel 32 in the second top surface 30 extends completely from the rear end 26 of the plug connector large body portion 28 to the front end 14 of the connector body 12, where it meets the ramped surface 40.

The front portion 20 of the connector housing 12 and the large body portion 28 of the connector housing 12 meet at a point 25 that is shown in the drawings as being located approximately midway between the first end 14 of the connector housing 12 and the second end 16 of the connector body portion 28. As can be seen in FIG. 1, the channel 32 extends from the second end 26 of the rear shell 28 to the inclined ramp surface 40, which extends downwardly from the channel bottom 34 toward the first top surface 24 and, at preferably an acute angle to the first top surface 24 of the front portion 20.

Still referring to FIG. 1, a thin, elongated rectangular plug connector actuator 60 is provided and it is sized and shaped to fit into the channel 32 such that it lies between the opposing sides 36 and 38 of the channel, while being able to freely slide toward and away from the first end 14 of the connector body 14. One end, the rear end 62, of the actuator 60 is shown as flared outwardly in order to define a pull tab, as shown in FIG. 1 to make it readily graspable. The opposite or second (front) end 64 of the actuator 60 is shown as being formed with an enlarged cam portion, shown in FIGS. 1-4 as a rounded "lobe" or cam shape, similar to a horizontal cylinder.

The actuator 60 preferably has an overall length 66 is such that the rear end 62 thereof lies beyond the second end 16 of the connector housing 12 where it can be grasped, but also so that the front end 64 end will ride against the inclined ramp surface 40 as the actuator 60 is pulled and slides away from the first end 14 of the connector body 14. As will be appreciated, the lateral movement of the second end 64 against the ramp segment 40 causes the lobe to rise and fall relative to both the first top surface 24 and the second top surface 30. Thus, the lateral movement of the actuator 60 is converted to vertical movement of the latching arm 42, the limit of which is established in part by the difference in height of the channel bottom 34 and the top surface 24 of the front portion 20.

The plug connector 10 can be locked or "latched" into a mating receptacle connector 22 by way of hooks or "barbs" 56 which are located at the free end of a resilient, cantilevered latching arm 42 which is partially fixed to the top surface 30 of the rear shell 28. In a preferred embodiment, the latching arm 42 is made of a relatively stiff sheet metal or plastic. By fixing one end 44 of the latching arm 42 to the top surface 30 of the body portion 28, and by leaving the opposite end 46 free, the flexural rigidity of the latching arm 42 acts to bias the latching arm 42 (and the barbs 56 at the second end 46 of the latching arm 42 downwardly, i.e., toward the first top surface 24 of the front shell 20. By bending the latching arm 42 downwardly at the inflection point 50, the barbs 56 at the second end 46 of the latching arm 42 can be made to engage openings or slots 57 that are formed in the guide frame 22, thereby locking (i.e., latching) the plug connector 10 into engagement with the guide frame 22. The forward edges of the engagement hooks may be angled as shown, so that when the plug connector is pushed into place, the engagement hooks 56 ride up onto the surface of the guide frame and into the openings 57.

Figure 2:
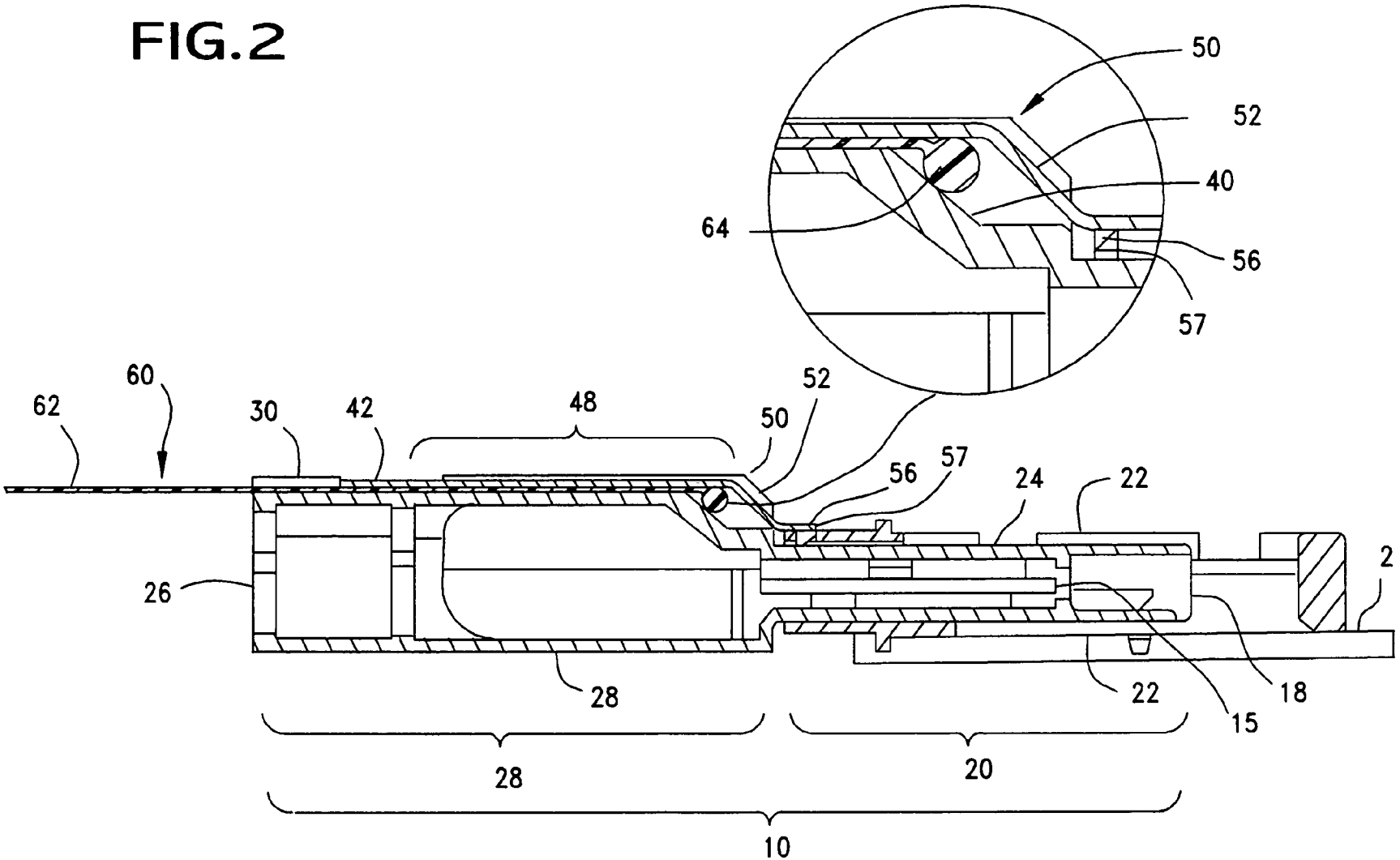
FIG. 2 is a sectional view of the plug connector of FIG. 1 inserted into a mating receptacle connector, and illustrating the latching member hooks barb engaged with the guide frame that houses a receptacle connector.
Figure 3:
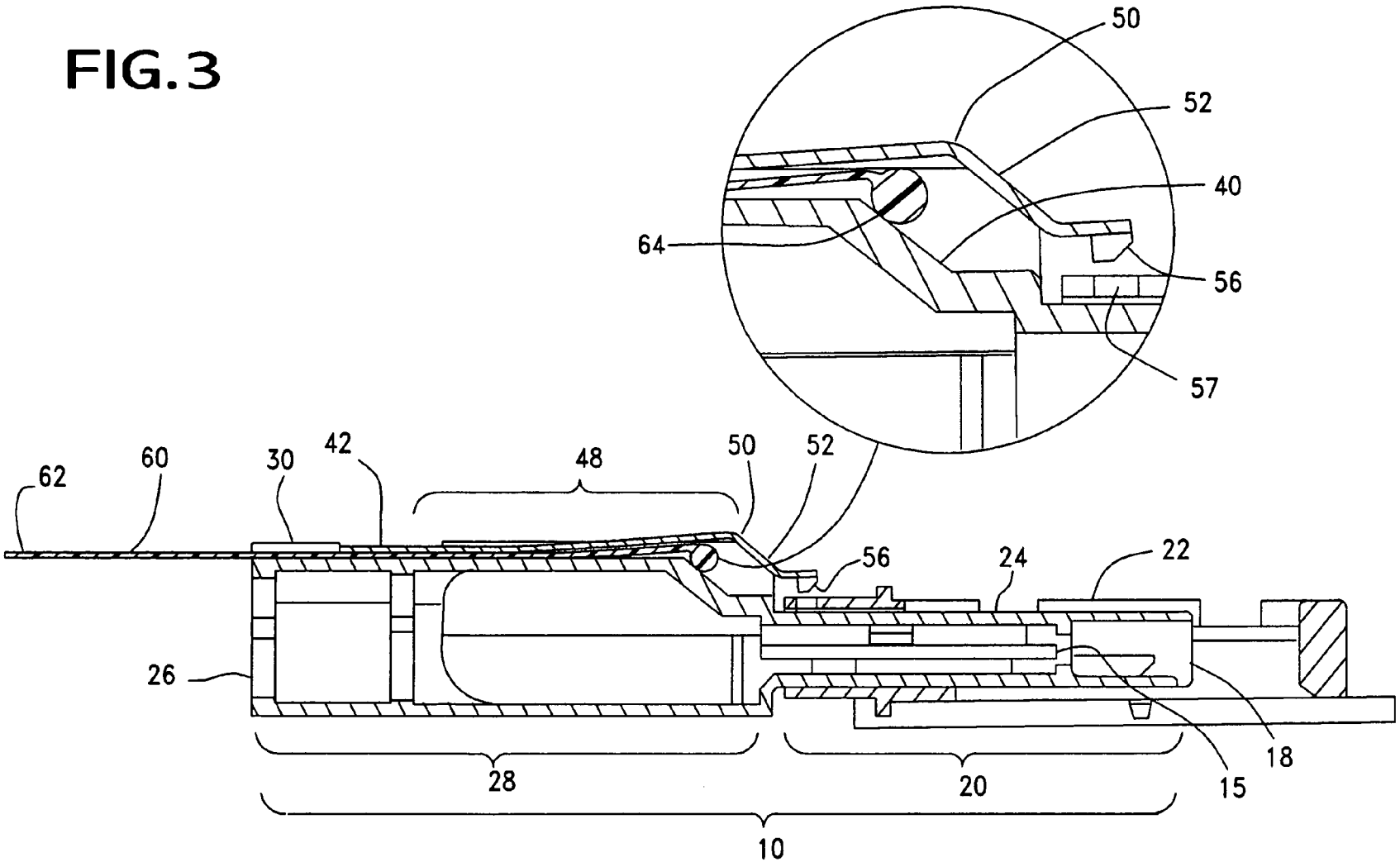
FIG. 3 is the same view as FIG. 2, but illustrating that latching member hooks disengaged from the guide frame.

As shown in FIGS. 2 & 3, the latching member 42 preferably has a configuration that generally conforms to the ramp surface 40. By shaping the latching member 42 to conform to the ramp surface 40, the underside of the latching arm 42 that is above the ramp surface 40 lies against the lobe that is formed at the second end 64 of the actuator 60. When the lobe moves rearward in response to the actuator 60 being pulled away from first end 14 of the connector body 14, the movement of the lobe up the ramp surface 40 causes the latching member 42 to rise relative to both the first top surface 24 and the second top surface 30. Likewise, when the lobe is pushed back forwardly, the movement of the lobe down the ramp surface 40 causes the latching arm to lower. This raising and lowering of the latching arm 42 results in the engagement hooks raising out of their slots 57.

Those of ordinary skill in the art will appreciate the simplicity of the plug connector's 10 disengagement from a mating receptacle connector simply by pulling on the easily grasped end 62 of the actuator 60, which causes the engagement hooks 56 at the second end 46 of the latching arm 42 to be lifted out of the slots 57 into which the hooks 56 extend to engage the guide frame 22.

The latching arm 42 has first and second opposing ends 44, 46 respectively. A rectangularly-shaped mid section 48 lies between the first end 44 and a deflection point 50 where the latching arm 42 is bent downwardly toward the first top surface 24. From the deflection point 50, there is an inclined segment 52 that terminates at the second end 46 which is formed to have engagement hooks 56, which in the preferred embodiment project downwardly from the second end 46 and into receiving slots 57. As shown in FIG. 1, the mid-section 48 lies above the actuator 60 and above the channel bottom 34. As is also shown, the deflection point 50 located near the "top" of and is also above the ramp surface 40. The deflection point 50 bend follows the slope of the ramp segment 40.

FIG. 2 is a side view of the plug connector 10 engaged into a the guide frame 22. The inset of FIG. 2 is an enlargement of the plug connector 10 showing the engagement of the hook 56 into a hole 57 in the opposing guide frame 22. It is also contemplated that the engagement hooks 56 may extend into slots or other openings that may be formed in a receptacle connector, rather than a guide frame, although such is not shown in the drawings. FIG. 2 also shows the ramp surface 40 that extends from the channel bottom 34 at an acute angle to the first top surface 24. As can be seen in FIG. 2, the lobed second end 64 of the actuator 60 rides on the surface of the ramp segment 40 causing it to rise and fall as the actuator 60 moves longitudinally (as shown in FIG. 2) in the channel 32.

FIG. 3 is another side view of the plug connector 10, but illustrating the lobed second end 64 of the actuator 60 moved further to the "left" of the connector, and therefore higher on the ramp surface 40. As can be seen in FIG. 3, movement of the actuator 60 to the left of FIG. 3 causes the lobed second end 64 to rise and lift the latching arm 42, and the engagement hooks 56 out of the slots 57 in the guide frame 22, releasing the plug connector 10 for its removal from the guide frame. The rearward extent of the actuator 60 assists in incorporating this type of latching mechanism in server and router applications where clearances are minimal and free space is at a premium.

Figure 4:
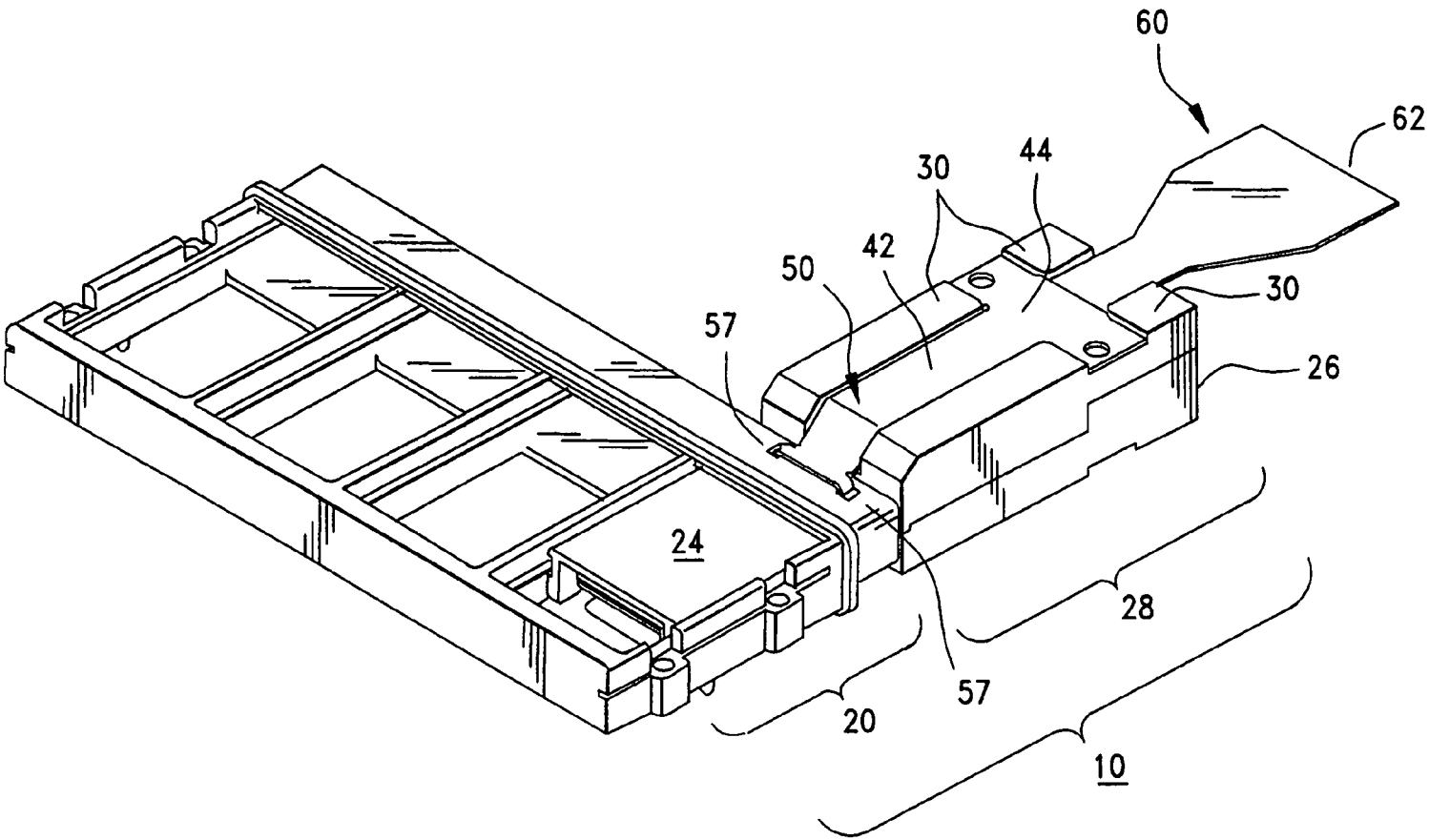
FIG. 4 is a perspective view of the plug connector installed into a guide frame and in mating engagement with a receptacle connector housed within the guide frame.

Finally, FIG. 4 is a perspective view of the plug connector 10 installed into a guide frame 22 with the engagement hooks 56 not visible because they are extended into the slots 57 in the guide frame 22. When the engagement hooks 56 are so engaged, the plug connector 10 cannot be removed from the guide frame 22, helping to insure the integrity of electrical connections between contacts in the front portion 20 and mating contacts in the receptacle connector 24.

The engagement hooks 56 of the plug connector that hold the plug connector in place are readily removed from their engagement with their corresponding slots 57 by pulling on the free rear end 62 of the actuator 60. The actuator 60 may be formed from a plastic or a metal or other similar material. As explained above and as depicted in FIG. 2 and FIG. 3, pulling on the actuator 60 in a direction away from the guide frame 22 causes the latching arm 42 to be lifted upwardly, bringing the engagement hooks 56 with it and freeing the plug connector from engagement with the guide frame 22.

In the preferred embodiment shown, the channel 32 formed into the top surface 30 of the rear shell 28 is "T" shaped (when viewed from above the connector housing 12) as is the first end 44 of the latching arm 42. Alternate and equivalent embodiments of the plug connector 10 may include using a linear channel 32, i.e., one that extends directly from the second end 16 of the connector body 16 to the ramp surface 40 without any sort of sideways extensions and a latching arm 42 that straddles the channel 32. Yet another embodiment contemplates a latching arm 42, the first end 44 of which is round or pan shaped such that the sliding of the underlying disengagement member 60 is not interfered with. By forming the channel 32 into a "T" shape, however, and forming the latching arm 42 first end 44 into such a mating shape, the material of the rear shell into which the channel 32 is formed becomes structure that resists removal force exerted on the latching arm 42 by forces exerted on the plug connector 10. The latching arm 42 is preferably a spring steel or rigid plastic. It is affixed to the top surface 30 of the rear shell 28 by rivets, adhesive or screws.

Alternate embodiments of the plug connector 10 contemplate an actuator 60, and the rear end 62 of which may include specific surface treatment to aid its being grasped. Corrugations, dimpling or stippling can be added to the rear end 62 to make it easier to grasp. In yet other embodiments, a pull string can be added to the rear end to which a fabric or otherwise flexible strip can be attached providing yet another improved structure for grasping the actuator that also helps identify a particular plug connector to be removed.

The connector housing 12 is preferably a molded plastic, the exterior surface of which may be metallized to provide EMI shielding to signals carried through the interior of the plug connector. In an alternate embodiment, the connector housing 12 may be die-cast or stamped from metal.

FIGS. 5-12 illustrate another embodiment of a plug connector 200 constructed in accordance with the principles of the present invention. As shown in FIG. 5, this connector 100 includes a connector housing 102 that is formed of two halves, a top half 104 and a bottom half 105, that cooperatively define the connector. The connector housing 102 has a front mating part 107 and a rear terminating part 106. The mating part 107 houses a plurality of electrical contacts, typically in the form of conductive traces on a circuit card that is mated to a connector of the style shown and described in U.S. patent application Ser. No. 11/176,515, the disclosure of which is hereby incorporated by reference.

The terminating part 106 is hollow and accommodates the free ends of wires (not shown) that are enclosed in a cable 1025. The cable 1025 enters the terminating part 106 through an opening in its rear wall and the individual cables wires are terminated to the traces of the internal circuit card 1020 by means well known in the art, such as soldering and the like. The terminating part 106 is larger in dimension than the mating part 107, as explained above, so that the extent to which the plug connector can be inserted into an opposing connector housing or guide frame is limited. In this manner, the front wall, or edge 157, of the terminating part 106 may be considered as a stop surface of the plug connector 100.

The connector includes a selectively manipulatable latch member 120 that takes the shape of a T-shaped arm and which includes an elongated body portion 121 that has two wing portions 123 that extend sideways thereof at and end portion 122 thereof. The end portion 122 (and preferably the body portion 121) is elevated slightly with respect to the wing portions 123 to create a cavity or recess therebetween, which is designated as gap 128 in FIG. 7. The wing portions 123 have holes formed therein that receive fasteners, such as rivets 140 and these fasteners 140 retain the rear portion of the latch member 120 fixed with respect to the free or latching end 125 thereof.

The latching end 125 is free to deflect and it includes one or more engagement members which are shown in the form of lugs or hooks, 127 that depend downwardly from the latching end. The latching end 125 is also offset from the latch member body portion 121 by an angled or ramped portion 126 which may be easily stamped and formed as part of the latch member. The latching end 125 has an extent sufficient to preferably space the engagement hooks 127 away from the front edge 157 of the terminating portion so that a space E (FIG. 9) is defined. This space accommodates a ring gasket 130 that is used to provide EMI shielding between the plug connector 100 and the housing into which it is inserted. The gasket 130 is preferably formed from a continuous band of elastomeric material that contains conductive matter so as to render it conductive in ways known in the art. The spacing of the engagement hooks 125 permits the mating part 107 to accommodate both the gasket 160 and the front end 125 of the latch member 120.

The plug connector 100 also includes an actuator by which the latch member is moved in or out of locking engagement with an opposing housing or guide frame. The actuator 110 preferably has an elongated shape as shown, with an elongated body portion 111, an actuating end 112 and a manipulating end 113, which has an opening 114 formed therein. A user may place their finger in the opening 114 or may grasp the ring surrounding the opening 114 in order to pull on the actuator and thereby move the latching arm up or down. The actuator body portion is held within a channel, or recess, 150 that is formed in the connector housing as well as that defined in part by the gap 28. This channel 150 includes a body portion 151 that extends longitudinally of the connector housing, a rear portion 155, two wing portions 154 and a front portion 152

The actuating end 112 includes a transverse member, shown in the drawings as a cylindrical pin or lobe 117 that is preferably disposed in an offset manner relative to the actuator body portion 111. This offset may be accomplished by way of an angled extent 116 that joins the pin 117 to the body portion 112. The body portion 114 of the actuator is disposed within a channel 150.

Figure 12B:
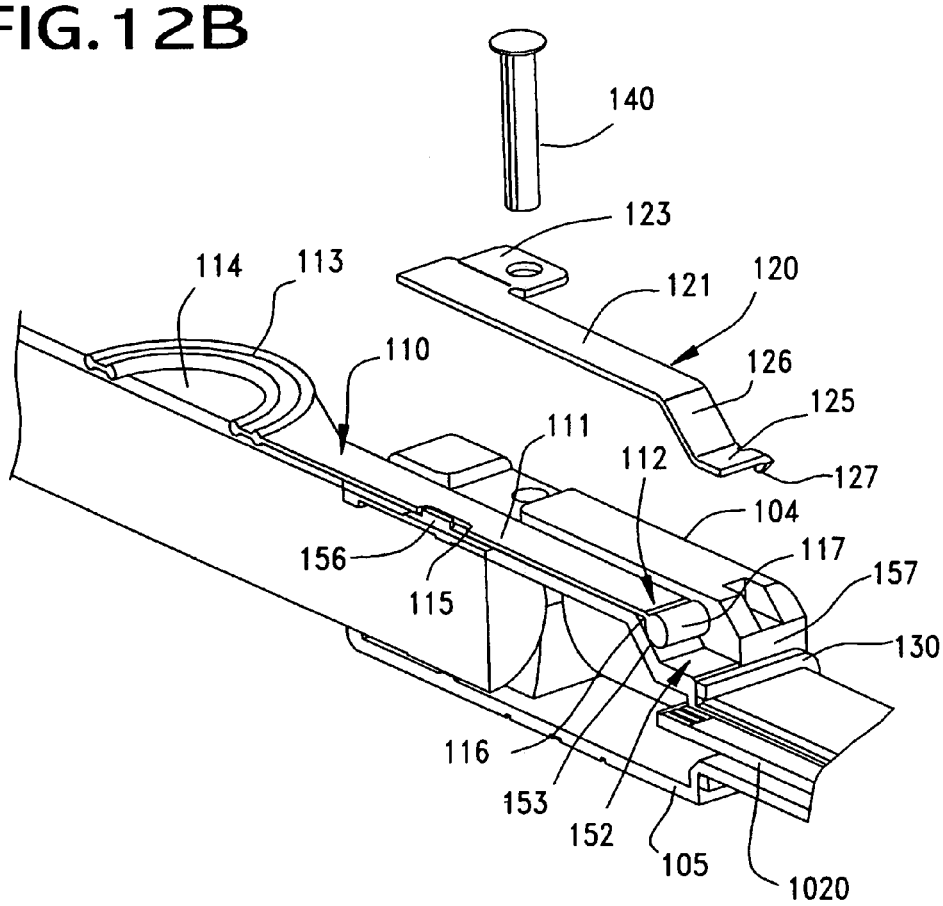
FIG. 12B is the same view as FIG. 12A, but with the latch member exploded away for clarity to illustrate the relationship between the actuator lobe and the ramped surface of the plug connector housing.

The channel 150 further includes a ramped surface 153 near its forward end 152, and as best shown in FIG. 12B, it accommodates the end lobe 117 of the actuator 110. The ramped surface 153 of the channel 150 defines an enclosure in which the lobe 117 is confined between the connector housing ramped surface 153 and the latch member 150. This confinement and the ramped surface translates the lateral motion of the actuator, when it is pulled or pushed, into an upward movement of the latching end 125 of the latch member 120. When the actuator 110 is pulled rearwardly, the lobe 117 rides along the ramped surface 153 and it contacts the underside of the latch member 120. Continued pulling of the actuator 110 results in the lobe 117 contacting the body portion 121 of the latch member and lifting that up. The cantilevered nature of the latch member 110 permits only movement of the free end 125 of the latch member, thereby disengaging the engagement hooks 127 from openings in the opposing guide frame or housing.

In order to facilitate the sliding movement of the actuator, the body portion 121 thereof may be raised with respect to the connector housing 102. This elevation is accomplished by offsetting the body portion 121 from the two wing portions 123 of the latch member 120. As seen best in FIGS. 6 & 7, this gap 128 is equivalent in dimension to the height of the angled portions 124 that join the wing portions 123 to the latch member body portion 121. Rivets or other similar fasteners 140 may be used to fasten the latch member near its rear end to the connector housing.

In order to provide a means for limiting the extent to which the actuator may be pulled, a stop member is provided on the connector housing and is disposed in the channel 150. This stop member is shown in the form of a raised lug, or boss 156 that rises up from the base of the channel 150. A slot 115 is formed in the actuator body portion 111, and preferably it has an elongated nature and a lengthwise dimension that is greater than that of the stop member 156. The difference, which is illustrated at T in FIG. 6 is the "throw" or the distance which the lobe 117 may be pulled rearwardly by an operator. This stop member 156 prevents the actuator from being pulled out of its position from underneath the latch member 120 and away from the plug connector housing.

The plug connectors of the invention may also be provided with means for orienting or keying the connector into engagement with an opposing connector. Such a means are illustrated in FIGS. 5-7 as a central slot 160 formed in the upper surface of the mating part 107 that is intended to engage a corresponding projection on an opposing guide frame or housing. It may also include one or more (and preferably a pair thereof) slots 161 that are formed in the sides of the mating part 107 and which also are intended to engage projections from the sides of the guide frame or housing. The central slot 160 is aligned as shown with the latch member 120 and as such, it may assist in aligning the engagement hooks 127 of the latch member 120 with their opposing openings when the plug connector is inserted into a guide frame or housing.

Figure 13:
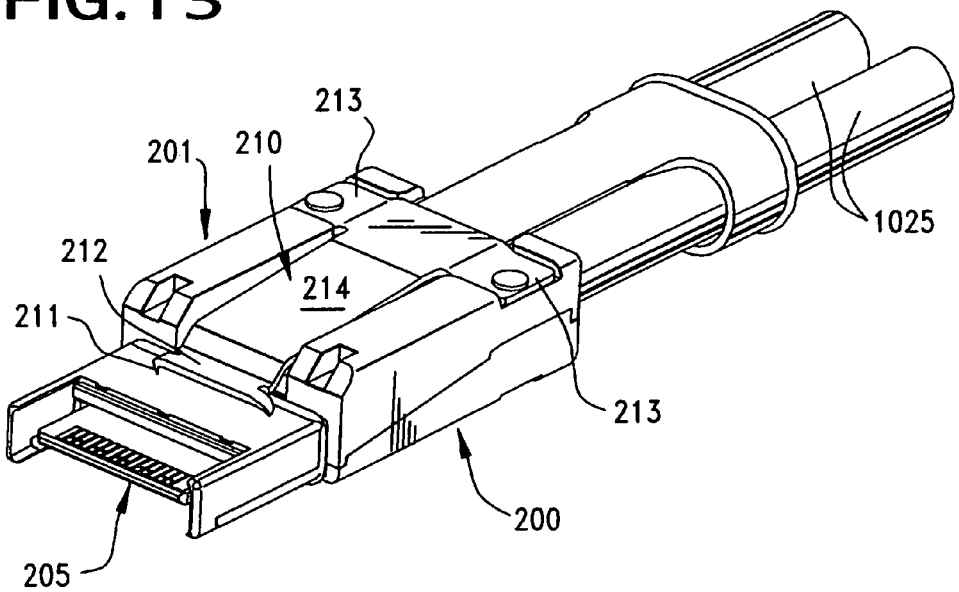
FIG. 13 is a perspective view of a third embodiment of a plug connector constructed in accordance with the principles of the present invention.
Figure 14:
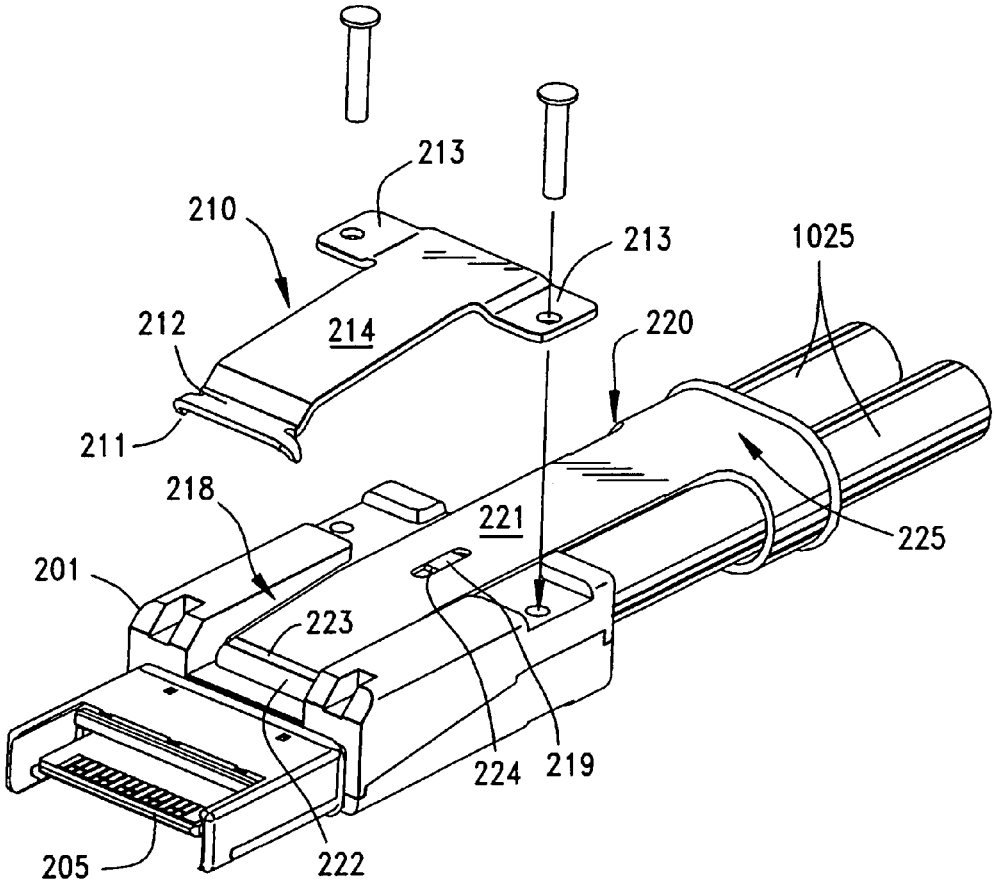
FIG. 14 is the same view as FIG. 13, but with the latch member exploded away for clarity to show the placement of the actuator upon the plug connector housing.
Figure 15:
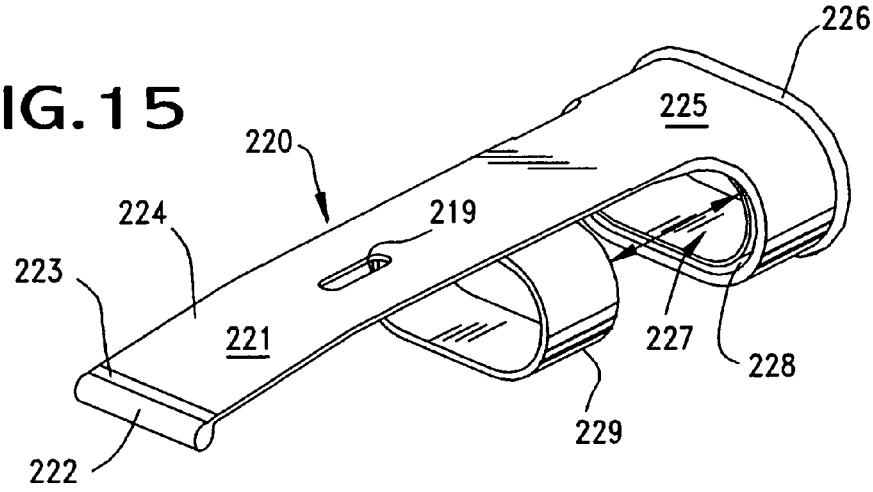
FIG. 15 is a perspective, exploded view of the actuator used in the plug connector of FIG. 13.

FIGS. 13-15 illustrate another embodiment of a plug connector 200 of the invention, in which the actuator 220 has a different configuration than those previously described. The connector 200 has a housing 201 that receives multiple cables 1025, each cable containing multiple wires therein. The housing 201 supports a circuit card 205 as its mating portion, the leading edge of which extends in a forward direction away from the connector housing 201. The connector includes a latching member 210 of the type previously discussed above, with a pair of engagement hooks 211 formed at a front end 212 thereof. The latching member 210 has two wing portions 213 that extend to the side of the center body portion 214 thereof, and these wing portions 213 are fastened to the connector housing so as to enclose the actuator 220.

The actuator 220 is shown in FIG. 14 in place on the connector housing 201 with the latching member 210 removed and it can be seen that is has a body portion 221 that is received within a channel 218 formed in the top surface of the connector housing. The actuator has a free end with an enlarged portion that serves as a cam and is illustrated as a lobe, or cylindrical pin 222 that extends sideways or transverse to the actuator body portion 221. An angled portion 223 is interposed between the lobe 222 and the body portion 221 to offset the lobe with respect to the body portion 221. The actuator also includes a slot 224 that receives a lug 224 in order to limit the extent of longitudinal travel of the actuator 220.

FIG. 15 illustrates best the difference in the structure of this actuator 220 with that of the previous embodiments. The actuator body portion 221 mates with a loop portion 225 that is continuous in its extent transverse to the body portion 221. The loop portion 225 is relatively thick and includes an inner annular slot 228 that receives a metal sleeve 229 therein to provide a sufficiently strong and reliable gripping surface. If desired, the loop may be provided with an annular, raised ridge 226 for a positive grasping surface. The forward end of the actuator 220 may also be formed at a slight downward angle, to facilitate its movement upon the ramped surface 250 of the channel 249. With such a structure, an operator may utilize a simple push-pull motion to lift or lower the engagement hooks.

Figures 16, 17:
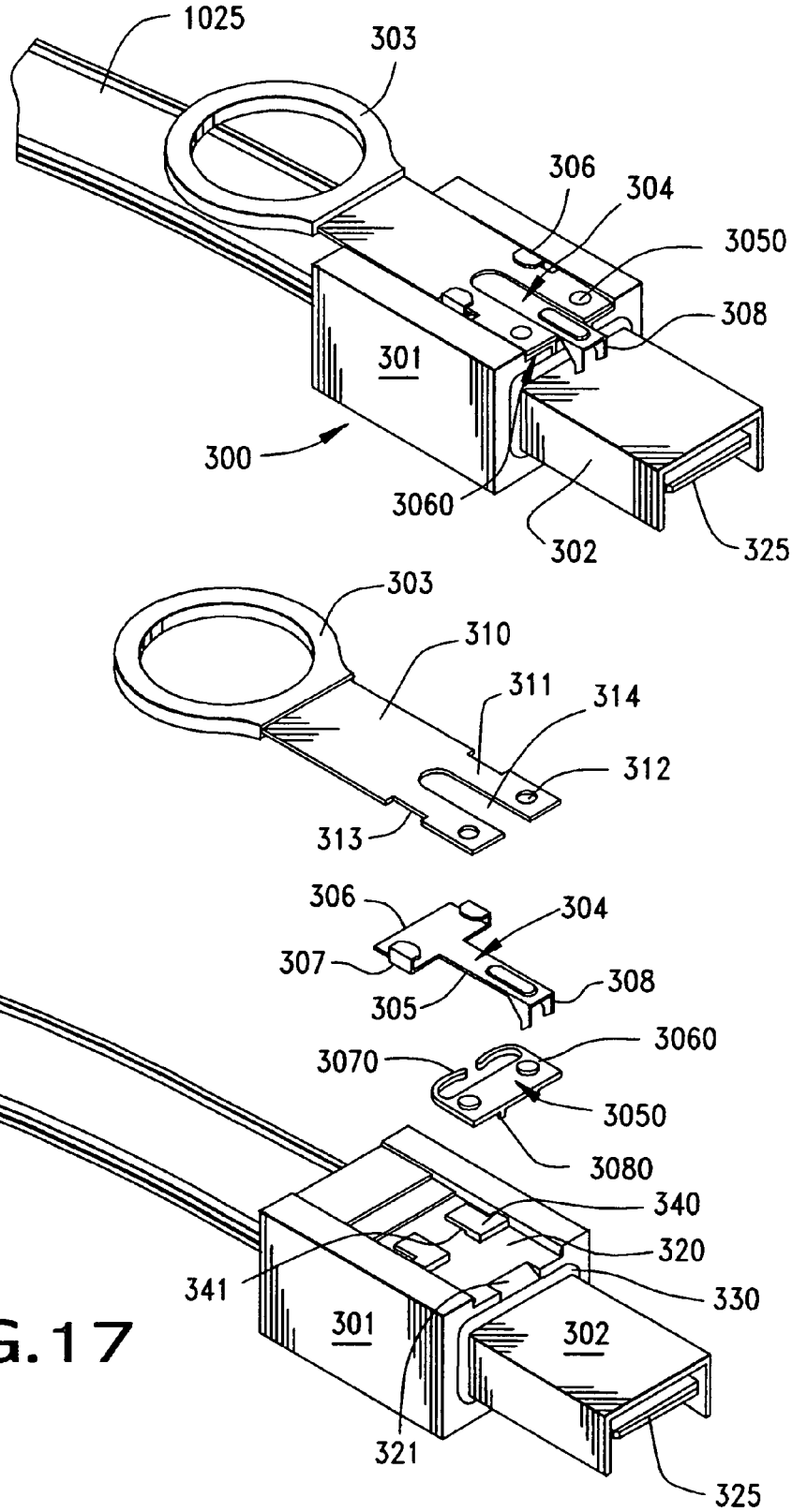
FIG. 16 is a perspective view of another embodiment of a connector constructed in accordance with the principles of the present invention; and, FIG. 17 is the same view as FIG. 16, but with the components illustrated in an exploded format for clarity.

FIGS. 16 & 17 illustrate another embodiment of a connector of the invention, but one in which the actuator is formed of multiple parts. A plug connector 300 is shown having a multiwire cable 1025 entering its rear. The connector has a housing that is shown having two portions, a front mating portion 302 that is inserted into the guide frame or housing of an opposing connector (not shown) and a rear portion 301 which holds the exposed ends of the wires of the cable 1025. Those wires are terminated to a circuit card 325 which serves as the preferred style of mating blade for the connector. The rear portion 301 is larger in size than the mating portion 302 and the connector thus has a "stepped" appearance when viewed from one of its side. The difference in size prevents the plug connector 300 from being inserted too far into engagement with the mating connector.

A flexible EMI gasket 330 is provided and it encircles the mating portion 302 and sits thereon near the face of rear portion 301 to provide a seal against EMI radiation when in use. The rear portion 301 has a channel 320 formed therein that receives a latching assembly. This channel 320 has a ramped surface 321 at its leading edge for providing a cam surface for the actuator to ride upon. It further includes a pair of blocks 340 that rise up in the channel 320 and each of the blocks 340 has a retainer section 341 formed therewith which are spaced apart from the surface of the channel 320 by an intervening airspace.

The latching assembly includes a latching member 304 having a general T-shaped configuration with a wing or arm portion 307 extending transversely to an elongated body portion 305. A pair of clips 307 are disposed at ends of the wing portion 306 and one or more engagement hooks 308 are disposed at the leading end of the latching member 304. An actuator 310 is provided and serves as a means by which to raise and lower the engagement hooks 308, which engage openings formed in an opposing guide frame or housing (not shown). A base plate 3060 is provided and it sits within the channel 320. It has a pair of legs, or lugs 3080, that extend away from it into contact with the channel 320 and particularly, the ramped surface 321, thereof. The base plate 3060 has a pair of return arms 3070 formed at an end thereof and also includes one or more bosses 3050 by which to engage an actuator handle 311 that has a pull ring 303 formed on a trailing end thereof and a pair of arms separated by an intervening space 314 at the leading end thereof. These arms include openings 312 that engage the bosses 3050 of the base plate 3060.

When the pull ring 303 is pulled rearwardly, the actuator handle 311 also draws rearwardly. Because it is connected to the base plate by way of the its openings 312 and the base plate bosses, the base plate moves rearwardly and rides up on the ramped surface 321 against the latching member 304, thereby causing the engagement hooks 308 to lift up out of engagement with the openings in the opposing guide frame or housing. The extent to which the actuator handle can be pulled rearwardly is controlled by the two clips 307 of the latching member, which are partly received in the slots between the retainer sections 341 of the blocks 340. The clips 307 are further received in slots 313 that are formed along the side edges of the actuator handle 310, thereby limiting the extent to which the actuator handle can be moved. The base plate return arms 3070 contact and bear against the front edges of the blocks 340 when the actuator handle is pulled rearwardly and they provide a forward biasing force to return the actuator handle 310 to its initial position when the pull ring 303 is released.

While the preferred embodiment of the invention has been shown and described, it will be apparent to those of ordinary skill in the art that changes and modifications may be made thereto without departing from the spirit of the invention, the scope of which is defined by the following claims.

What is claimed is:

1. An electrical connector comprising:

a housing;

a plurality of conductive contacts located in the housing; a cable electrically connecting with the conductive contacts;

an actuator moveable relative to the housing in a horizontal direction; and, a latch member discrete from the actuator and assembled to the housing for latching with the complementary connector, the latch member comprising an engaging portion assembled to said housing; an actuation section positioned forwardly from the engaging portion and actuated by a cooperating portion of the actuator, and a front latch portion extending forwardly from the engaging portion for latching to the complementary connector; wherein the latch member is operated in a lever manner.

2. The electrical connector of claim 1, wherein the housing includes a body portion and a front portion smaller than the body portion in a cross-sectional view and extending forwardly from a front face of the body portion, and wherein the latch portion extends beyond the front face and is located above the front portion.

3. The electrical connector of claim 1, wherein the actuator is moveable in a horizontal direction.

* * * * *